US005540389A

United States Patent [19]

Knickerbocker

[11] Patent Number: 5,540,389

[45] Date of Patent: Jul. 30, 1996

[54] TERMINAL ORIFICE SYSTEM

[75] Inventor: Michael G. Knickerbocker, Crystal Lake, Ill.

[73] Assignee: Aptar Group, Inc., Cary, Ill.

[21] Appl. No.: 294,054

[22] Filed: Aug. 24, 1994

[51] Int. Cl.[6] ..... B05B 1/34

[52] U.S. Cl. ..... 239/491; 239/463

[58] Field of Search ..... 239/491, 463, 239/461, 343, 340, 337, 333, 468, 399, 403, 405, 490, 492–497

[56] References Cited

U.S. PATENT DOCUMENTS

| | | | |
|---|---|---|---|
| 2,071,920 | 2/1937 | Czarnecki . | |
| 2,657,836 | 11/1953 | Heinz et al. . | |
| 3,383,052 | 5/1968 | Dysart et al. . | |
| 3,556,412 | 1/1971 | Vietorisz | 239/591 |
| 4,322,037 | 3/1982 | Heeb et al. | 239/337 |
| 4,979,678 | 12/1990 | Ruscitti et al. | 239/466 |
| 5,275,338 | 1/1994 | Tobler | 239/490 X |
| 5,397,059 | 3/1995 | Baudin | 239/333 |

FOREIGN PATENT DOCUMENTS

| | | | |
|---|---|---|---|
| 348638 | 1/1990 | European Pat. Off. | 239/491 |
| 2043488 | 10/1980 | United Kingdom | 239/492 |

*Primary Examiner*—Andres Kashnikow
*Assistant Examiner*—Lesley D. Morris
*Attorney, Agent, or Firm*—Frijouf, Rust & Pyle, P.A.

[57] ABSTRACT

An improved terminal orifice system is disclosed for a hand operated dispensing device for dispensing a product from a terminal orifice. The improved terminal orifice system comprises a spin chamber communicating with the terminal orifice with a plurality of feed channels providing communicating between the hand operated dispensing device and the spin chamber for spinning the product about an axis within the spin chamber prior to discharge from the terminal orifice. Each of the plurality of feed channels is tapered to control the flow rate of the product into the spin chamber.

21 Claims, 12 Drawing Sheets

PRIOR ART

PRIOR ART

PRIOR ART

PRIOR ART

Prior Art

TERMINAL ORIFICE SYSTEM

BACKGROUND OF THE INVENTION

1. Field of the Invention

This invention relates to dispensing, and more particularly to an improved terminal orifice system for a hand operated dispensing device having a spin chamber with a plurality of feed channels for spinning the product within the spin chamber prior to discharge from a terminal orifice.

BACKGROUND OF THE INVENTION

Hand operated dispensers may be classified into either aerosol dispensers or hand operated pump dispensers. In a standard aerosol dispenser, a product and a propellant is sealed within a container by a mounting cup. The mounting cup houses an aerosol valve having a dip tube for providing a fluid conduit between the aerosol valve and the bottom of the container. A valve button is secured to the aerosol valve by a valve stem. When the valve button is depressed, the aerosol valve is opened and aerosol product passes from the bottom of the container through the dip tube and the aerosol valve for discharge from a terminal orifice in the valve button.

In a standard hand operated pump dispenser, a product is sealed within a container by a container cap or closure. The container cap supports a hand operated pump commonly referred to as a finger pump. The hand operated pump communicates with a container dip tube for providing a fluid conduit between the hand operated pump and the bottom of the container. When the hand operated pump is actuated, the pump draws product from the bottom of the container through the dip tube to be projected by the pump from a terminal orifice of the pump.

In many cases, the terminal orifice of a hand operated dispenser includes a spin chamber for accelerating or increasing the velocity of the product. The spin chamber ensures the product expelled from the terminal orifice is broken down in the atmosphere after discharge from the terminal orifice to enhance the spray characteristics of the hand operated dispenser. The spin chamber associated with a terminal orifice is commonly referred to as a mechanical break-up unit (MBU).

The spin chamber typically comprises a cylindrical chamber having a plurality of feed channels disposed generally tangential to the cylindrical chamber wall. When the product is propelled through the feed channels into the cylindrical spin chamber, the product spins within the cylindrical chamber to be expelled through the terminal orifice which is axially aligned with the cylindrical spin chamber. The width of each of the feed channels at the intersection with the cylindrical spin chamber is limited to approximately one quarter the diameter of the cylindrical spin chamber in order to produce the proper angular rotation of the product within the spin chamber. If the feed channels are increased above this maximum level, the product propelled into the cylindrical spin chamber will not have the proper angular rotation therein and will not provide the proper velocity to the product within the cylindrical spin chamber.

Typically, the spin chambers are formed within an actuator button through the use of a terminal orifice insert. A cylindrical post is defined by an annular recess defined in a support with the terminal orifice insert engaging with the post to form the cylindrical spin chamber between the terminal orifice insert and the cylindrical end of the cylindrical post. The feed channels are formed between the terminal orifice insert and the outer cylindrical surface of the cylindrical post and form a ninety degree change in direction at the intersection of the cylindrical surface and the cylindrical end of the cylindrical post. The ninety degree change in direction in the feed channels at the intersection of the cylindrical surface and the cylindrical ends of the cylindrical post cause a substantial reduction in the flow rate of the product and propellant into the cylindrical spin chamber.

If the terminal orifice insert is not properly aligned with the cylindrical post, the terminal orifice insert will not properly engage with the cylindrical ends of the cylindrical post. When the terminal orifice insert is not properly engaged with the cylindrical ends of the cylindrical post the feed channels are not properly formed between the terminal orifice insert and the cylindrical post thus causing an imbalance between the plurality of feed channels. Accordingly some of the feed channels will provide more product than other feed channels to disturb the balance of the product entering the cylindrical spin chamber.

A further problem with the prior art spin chambers is due to the limitation of the area of the feed channels at the intersection with the cylindrical spin chamber. In general, this feed channel is configured to provide the proper spray characteristics from the terminal orifice of the hand operated dispenser. Unfortunately, this configuration of the feed channel to provide the proper spray characteristics in many cases provides a high back pressure within the cylindrical spin chamber thus reducing the flow rate of the product expelled from the terminal orifice.

Another difficulty of the prior art hand operated dispensers was the non-uniformity of the output flow channel from the dispenser to the terminal orifice spin chamber. In general, the configuration of the channel was primarily dictated by manufacturing convenience and provided a non-uniform area for the flow of product from the hand operated dispenser body into the cylindrical spin chamber. This non-uniformity resulted in unbalanced product flow as well as a reduced flow rate in the output flow channel. The non-uniformity in the output flow channel provided a non-uniform velocity to the product and propellant.

Many in the prior art have attempted to resolve these problems to provide a hand operated dispenser with a terminal orifice spin chamber. However, the attempts of the prior art have had only limited success.

U.S. Pat. No. 2,071,920 to Czarnecki discloses a nozzle unit comprising a housing and tip, the tip having a conically tapered chamber and a discharge orifice extending from the apex of the conical chamber, a spherical terminal member presenting a spherical segment within the taper of the conical chamber, the spherical member having a plurality of sockets, means engaging one of the sockets selectively to clamp the spherical member within the conical chamber, and kerfs formed in the spherical surface of the member opposite each of the sockets spanning the circle of engagement of the spherical member with the conical taper.

U.S. Pat. No. 2,657,836 to Heinez et al discloses a device for dispensing granular material comprising a container for the material having an open end, a cap secured to the open end thereof, the cap having a single discharge opening and being provided with an insert cooperating therewith to provide at least one closed spiral discharge path for the material, interconnecting the container and the discharge opening.

U.S. Pat. No. 3,383,052 to Dysart et al discloses a burner end cone comprising an annular body member having a fluid inlet opening at one end, a fluid outlet opening of reduced size at the opposite end, and an internal flow passage extending the length of the body member communicating the inlet with the outlet; a plurality of first flow directing vanes protruding from the interior surface of the body member into the flow passage and extending the length of the body member from the inlet opening to the outlet opening, the vanes being angularly displaced from a line parallel with the center axis of the body member; and a plurality of second flow directing partial vanes protruding from the interior surface of the body member, the second vanes being alternately disposed between the first vanes and extending from a point on the interior surface of the body member intermediate the ends to the fluid outlet.

U.S. Pat. No. 3,556,412 to Vietorias discloses a burner nozzle including a cylindrical shell having an inner lining of insulating material and a plurality of refractory units inside of the lining. The refractory units are complementary and form a plurality of channels that direct a gaseous fluid, flowing through the nozzle in a spirally converging manner into a mixing relation with another gaseous fluid flowing through the nozzle in an axial manner.

U.S. Pat. No. 4,979,678 to Ruscitti et al discloses an atomizer nozzle insert for hand pumps mounted on bottles, for the atomized dispensing of liquid products contained in the bottles, is of cup shape and comprises at least one turbulence channel of spiral extension provided in the inner end surface of the insert and opening into a coaxial turbulence chamber which communicates with the outside via a coaxial outlet bore for the atomized product. The turbulence channel also extends, with substantially helical extension, along the inner lateral wall of the insert.

Therefore, it is an object of the present invention to provide an improved terminal orifice system for a hand operated dispenser device having a feed channel with a high flow rate of the product into a cylindrical spin chamber to be expelled from the terminal orifice.

Another object of this invention is to provide an improved terminal orifice system for a hand operated dispenser device having a feed channel with a constant cross-sectional area along the length thereof into a cylindrical spin chamber.

Another object of this invention is to provide an improved terminal orifice system for a hand operated dispenser device having a feed channel that is radially tapered from a larger radial dimension to a smaller radial dimension at the intersections of the feed channel with a spin chamber and is axially tapered from a smaller axially dimension to a larger axial dimension at the intersections of the feed channel with the spin chamber to provide a substantially constant cross-sectional area in each of the feed channels.

Another object of this invention is to provide an improved terminal orifice system for a hand operated dispenser device having a feed channel that is arcuate for providing an arcuate ninety degree change in direction in the feed channel to provide a high flow rate of the product into a cylindrical spin chamber.

Another object of this invention is to provide an improved terminal orifice system for a hand operated dispenser device having a cylindrical post with a hemispherical post end for insuring a proper alignment of a terminal orifice insert with the cylindrical post.

Another object of this invention is to provide an improved terminal orifice system for a hand operated dispenser device that is suitable for use with existing aerosol dispensers and pumps.

Another object of this invention is to provide an improved terminal orifice system for a hand operated dispenser device that maybe secured to existing aerosol dispensers and existing pumps with conventional assembling equipment.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved terminal orifice system for a hand operated dispensing device for dispensing a product from a terminal orifice. The improved terminal orifice system comprises a spin chamber communicating with the terminal orifice. A plurality of feed channels provide communication between the hand operated dispensing device and the spin chamber for spinning the product about an axis within the spin chamber prior to discharge from the terminal orifice. Each of the plurality of feed channels is tapered relative to provide a smaller radial dimension at an intersection of each of the feed channels with the spin chamber while providing a substantially constant cross-sectional area along each of the feed channels.

In a more specific embodiment of the invention, the spin chamber is substantially cylindrical about the axis and with the terminal orifice being located along the axis. Each of the plurality of feed channels is disposed tangentially relative to the spin chamber at each of the intersections of the feed channels with the spin chamber.

Preferably, each of the plurality of feed channels is radially tapered relative to the axis from a larger radial dimension to a smaller radial dimension at each of the intersections of the feed channels with the spin chamber. Furthermore, each of the plurality of feed channels is axially tapered relative to the axis from a smaller axially dimension to a larger axial dimension at each of the intersections of the feed channels with the spin chamber to provide a substantially constant cross-sectional area in each of the feed channels.

In another embodiment of the invention, a support has an output channel in communication with the hand operated dispensing device. A recess is formed in the support communicating with the output channel and defining a post having an outer post surface and a substantially hemispherical post end. A terminal orifice insert is insertable within the annular recess of the support for defining a spin chamber between the substantially hemispherical post end of the post. The terminal orifice insert defines a plurality of feed channels between the post and the terminal orifice insert for providing communication between the output channel and the spin chamber for spinning the product within the spin chamber prior to discharge from the terminal orifice. The substantially hemispherical post end provides each of the plurality of feed channels to be arcuate between the outer post surface and the substantially hemispherical post end.

In a more specific embodiment of this invention, the recess is an annular recess formed in the support for defining a post having a substantially cylindrical outer post surface and a substantially hemispherical post end. The spin chamber is substantially cylindrical about an axis with the axis of the spin chamber being aligned with a post axis of the substantially cylindrical outer post surface. The substantially hemispherical post end provides each of the plurality of feed channels to be arcuate through an angle of substantially ninety degrees between the outer post surface and the substantially hemispherical post end.

Preferably, each of the plurality of feed channels is radially tapered relative to the axis from a larger radial dimension to a smaller radial dimension at each of the intersections of the feed channels with the spin chamber. In addition, each of the plurality of feed channels is axially tapered relative to the axis from a smaller axially dimension to a larger axial dimension at each of the intersections of the feed channels with the spin chamber to provide a substantially constant cross-sectional area in each of the feed channels.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
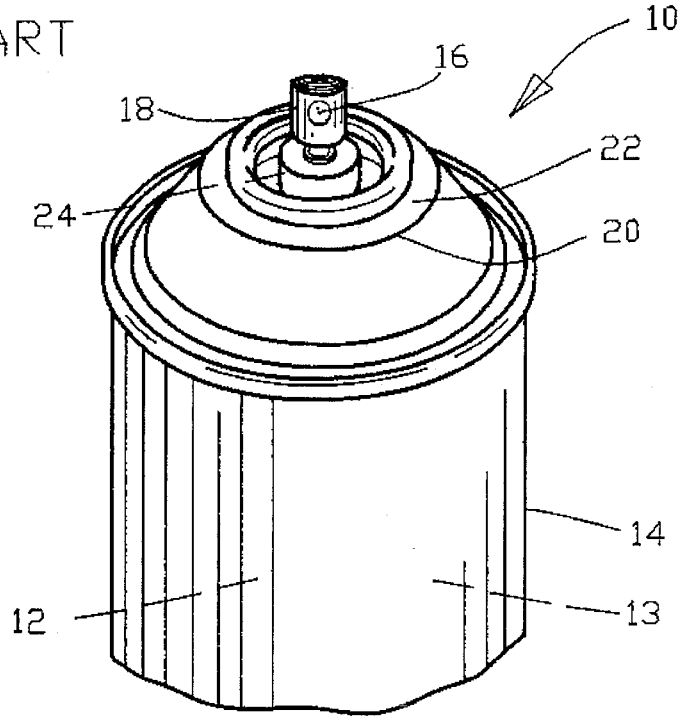
FIG. 1 PRIOR ART
FIG. 1 is an isometric view of a prior art dispensing device shown as an aerosol dispenser secured to a container for dispensing product from a terminal orifice.

FIG. 1 is an elevational view of a first prior art dispenser shown as an aerosol dispenser 10 for dispensing a product 12 and a propellant 13 within a container 14 from a terminal orifice 16 upon depression of an actuator button 18 by an operator. The container 14 has a peripheral rim 20 for receiving a mounting cup 22 with the mounting cup 22 being crimped to the peripheral rim 20 of the container 12 in a conventional manner. The mounting cup 22 supports an aerosol dispenser assembly 24 of a conventional design.

Figure 2:
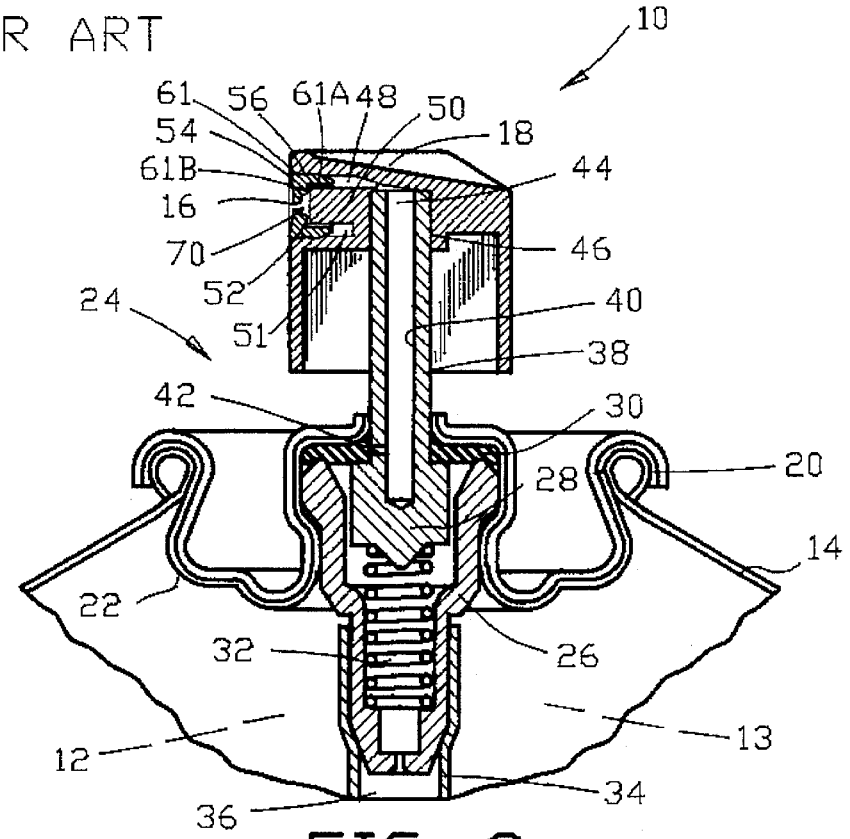
FIG. 2 is an enlarged partial sectional view of the aerosol dispenser of FIG. 1.

FIG. 2 is an enlarged partial sectional view of the prior art aerosol dispenser assembly 24 of FIG. 1 illustrating a valve body 26 being secured to the mounting cup 22. An aerosol valve 28 is biased into engagement with a sealing gasket 30 by a spring 32. A dip tube 34 having an internal channel 36 is secured to the valve body 26 for communicating with the product 12 within the container 14. The aerosol valve 28 includes a valve stem 38 having a stem channel 40 communicating between a metering orifice 42 and a stem aperture 44. The actuator button 18 is secured to the valve stem 38 with the terminal orifice 16 communicating with the stem aperture 44.

The actuator button 18 includes a bore 46 for frictionally receiving the valve stem 38 with the stem channel 40 communicating with an annular passage 48 defined by a cylindrical post 50. The cylindrical post 50 comprises a cylindrical outer post surface 51 terminating in a planar cylindrical end 52. The terminal orifice 16 is located in an insert 54 disposed within the annular passage 48 and secured therein by a cooperating projection and recess 56. A feed channel 61 is defined between the cylindrical post 50 and the insert 54. The feed channel 61 comprises an axial portion 61A defined between the cylindrical outer post surface 51 and the insert 54 and a radial portion 61B defined between the planar cylindrical end 52 and the insert 54. The feed channel 61 communicates the product 12 and the propellant 13 from the annular passage 48 to a spin chamber 70 for spinning the product 12 prior to being discharged from the terminal orifice 16.

The operation of the prior art aerosol dispenser assembly 24 should be well known to those skilled in the art. The aerosol valve 28 is movable between a closed position as shown in FIG. 2 and an open position upon the depression of the actuator button 18 by an operator as should be well known in the art. Upon the movement of the actuator button 18 by an operator, the aerosol valve 28 is moved into the open position whereat the propellant 13 forces the product 12 from the dip tube 34 through the metering orifice 42 and the stem channel 40 to continue from the stem aperture 44 into the actuator button 18 to be discharged from the terminal orifice 16.

Figure 3:
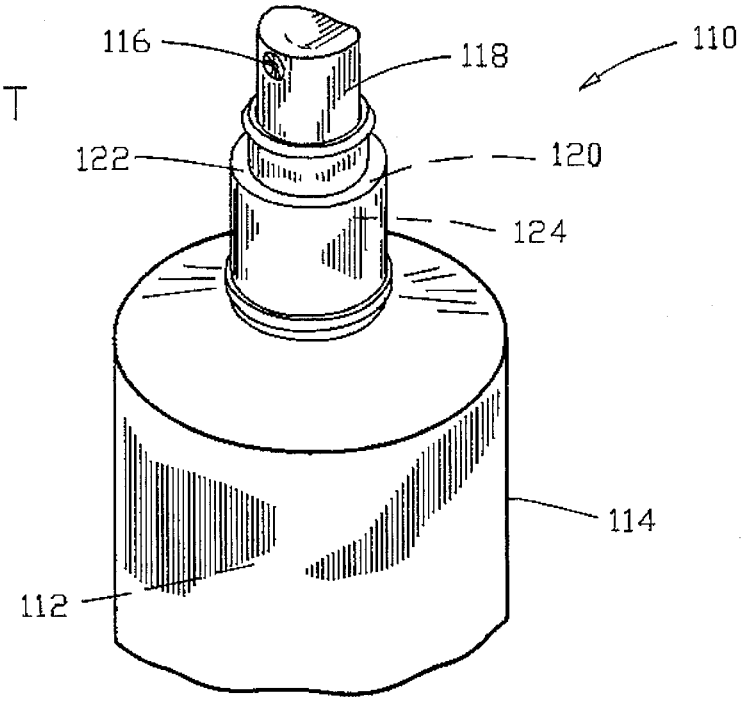
FIG. 3 PRIOR ART
FIG. 3 is an isometric view of a prior art dispensing device shown as a hand operated pump secured to a container for dispensing product from a terminal orifice.

FIG. 3 is an elevational view of a second prior art dispenser shown as a pump dispenser 110 for dispensing a product 112 within a container 114 from a terminal orifice 116 upon depression of an actuator button 118 by an operator. The container 114 has a peripheral rim 120 for receiving a closure 122 with the closure 122 being secured to the peripheral rim 120 of the container 112 in a conventional manner. The closure 122 supports a pump dispenser assembly 124 of a conventional design.

Figure 4:
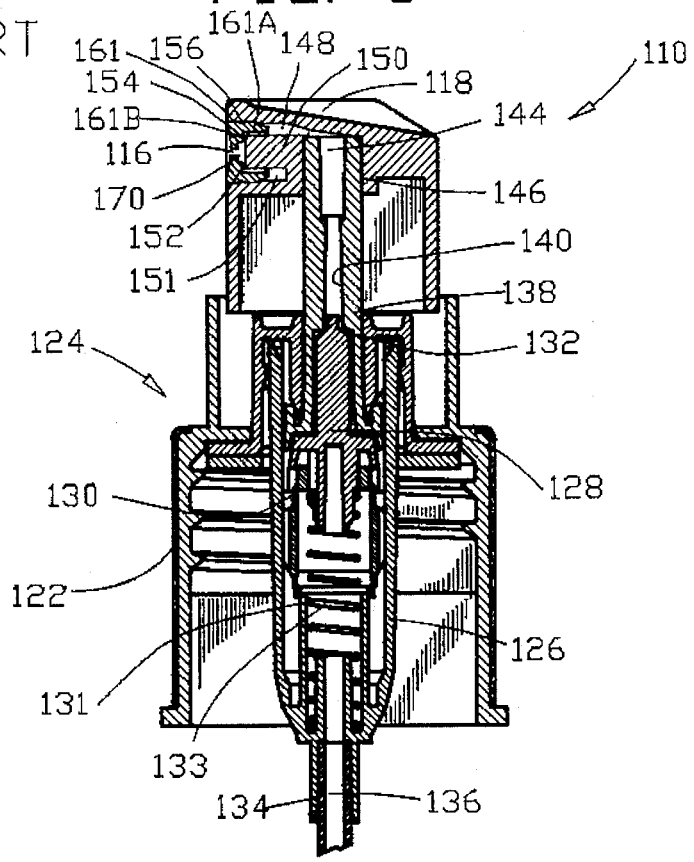
FIG. 4 is an enlarged partial sectional view of the hand operated pump of FIG. 1.

FIG. 4 is an enlarged partial sectional view of the prior art pump dispenser assembly 124 of FIG. 3 illustrating a pump body 126 being secured to the closure 122. The pump dispenser assembly 124 comprises a pump piston 128 disposed in a pump chamber 130 between first and second one way valves 131 and 132. The pump piston 128 is slidably disposed within the pump chamber 130 of the pump body 126 for frictionally engaging with the pump chamber 130 to form a slidable seal therebetween.

The pump piston 128 is biased by a spring 133 into an extended position. A dip tube 134 having an internal channel 136 is secured to the pump body 126 for communicating with the product 112 within the container 114. The pump piston 128 includes a piston stem 138 having a stem channel 140. The actuator button 118 is secured to the piston stem 138 with the terminal orifice 116 communicating with the stem aperture 144.

The actuator button 118 includes a bore 146 for frictionally receiving the pump stem 138 with the stem channel 140 communicating with an annular passage 148 defined by a cylindrical post 150. The cylindrical post 150 terminates in a planar cylindrical end 152. The terminal orifice 116 is located in an insert 154 disposed within the annular passage 148 and secured therein by a cooperating projection and recess 156. A feed channel 161 is defined between the cylindrical post 150 and the insert 154. The feed channel 161 comprises an axial portion 161A defined between a cylindrical outer post surface 151 and the insert 154 and a radial portion 161B defined between the planar cylindrical end 152 and the insert 154. The feed channel 161 communicates the product 112 from the annular passage 148 to a spin chamber 170 for spinning the product 112 prior to being discharged from the terminal orifice 116.

The first one-way valve means 131 enables the flow of the product 112 only from the container 114 into the pump chamber 130 of the pump body 126. The second one-way valve 132 enables the flow of the product 112 only from the pump chamber 130 into the stem channel 140 of the pump stem 138.

The operation of the prior art pump dispenser assembly 124 should be well known to those skilled in the art. As the actuator button 118 is depressed by the operator, the first one-way valve 131 closes and the volume of the pump chamber 130 is reduced by continued depression of the actuator button 118 by the operator. When the actuator button 118 is released by the operator, the pump chamber 130 is expanded to open the first one-way valve 131 to withdraw the product 112 from the container 114 into the pump chamber 130. Upon a subsequent depression of the actuator button 118 by the operator, the volume of the pump chamber 130 is again reduced by continued depression of the actuator button 118 by the operator. The reduced volume of the pump chamber 130 increases the pressure therein to open the second one-way valve 132 for forcing the product 112 from the pump chamber 130 through the stem channel 140 and the stem aperture 144 into the actuator button 118 to be discharged from the terminal orifice 116.

Although the pump dispenser 110 has been shown as a vertical action pump with a finger actuator button 118, it should be understood that the present invention may be incorporated into a trigger pump of various configurations or other types of manually operated pumps.

Figure 5:
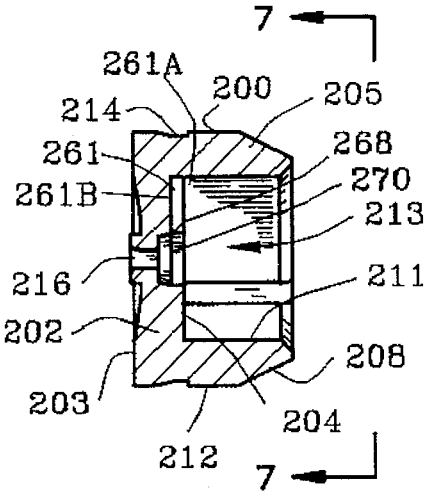
FIG. 5 PRIOR ART
FIG. 5 is a twice enlarged side section view of a prior art terminal orifice insert for a dispenser.
Figure 7:
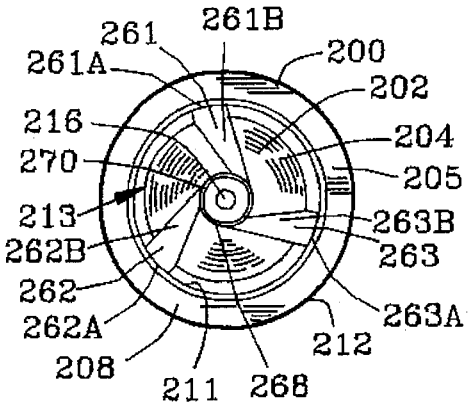
FIG. 7 PRIOR ART
FIG. 7 is a view along line 7—7 of FIG. 5.

FIG. 5 is a twice enlarged side section view of a prior art terminal orifice insert 200 with FIG. 7 being a view along line 7—7 of FIG. 5. The terminal orifice insert 200 comprises a front wall 202 having an outer face 203 and an inner face 204. The terminal orifice insert 200 further comprises an annular wall 205 with a taper end 208 for facilitating the insert of the terminal orifice insert 200 as will be described in greater detail hereinafter. The annular wall 205 includes an inner surface 211 and an outer surface 212 with the outer surface 212 defining a generally cylindrical void 213 communicating with a terminal orifice 216. The annular wall 205 includes an annular recess 214 for securing the terminal orifice insert 200 as will be described in greater detail hereinafter.

Figure 6:
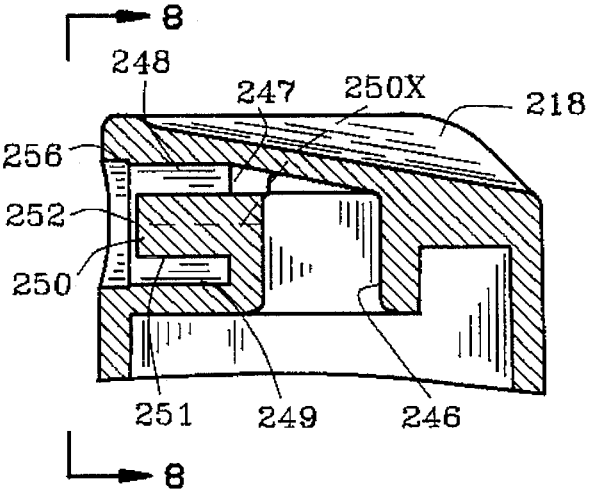
FIG. 6 PRIOR ART
FIG. 6 is an enlarged side section view of a portion of a prior art actuator for the dispenser.
Figure 8:
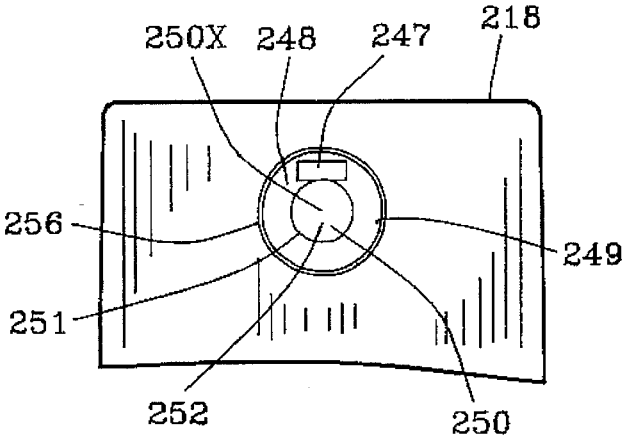
FIG. 8 is a view along line 8—8 of FIG. 6.

FIG. 6 is an enlarged side section view of a portion of a prior art actuator button 218 with FIG. 8 being a view along line 8—8 of FIG. 6. The actuator button 218 includes a bore 246 for frictionally receiving a stem such as the stems 38 and 138. A port 247 interconnects the bore 246 with an annular passage 248 defined by a cylindrical actuator wall 249 and a cylindrical post 250. The cylindrical post 250 defines a substantially cylindrical outer post surface 251 about an axis 250X and terminates in a planar cylindrical end 252. An annular projection 256 is defined in a cylindrical actuator wall 249 for cooperating with the annular recess 214 for securing the terminal orifice insert 200 to the actuator button 218 as will be described in greater detail hereinafter.

Figure 9:
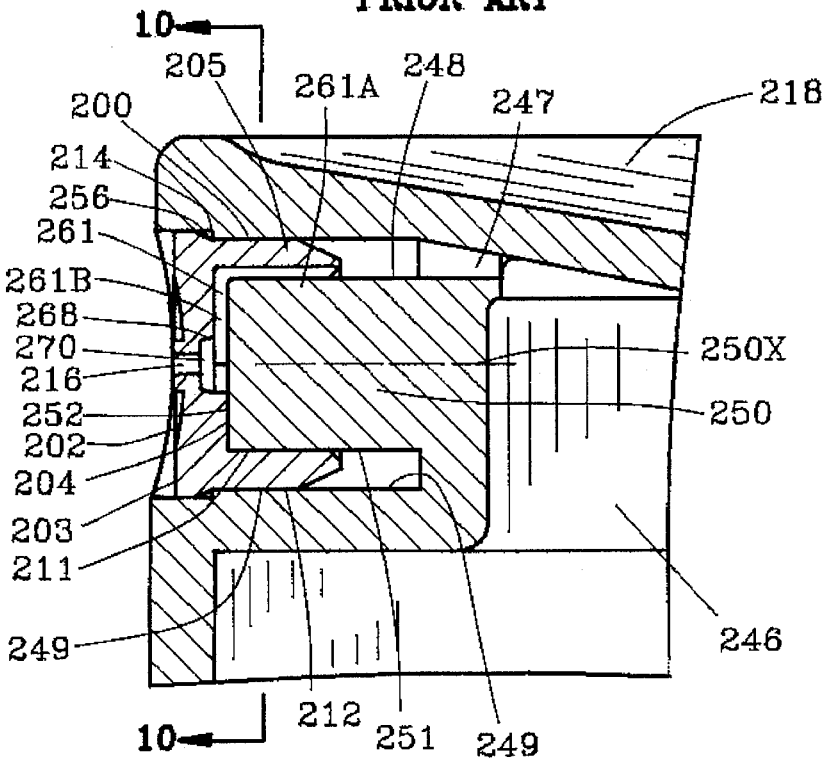
FIG. 9 PRIOR ART
FIG. 9 is an enlarged side section view of a portion of the actuator of FIGS. 6 and 8 with the terminal orifice insert of FIGS. 5 and 7 inserted therein.
Figure 10:
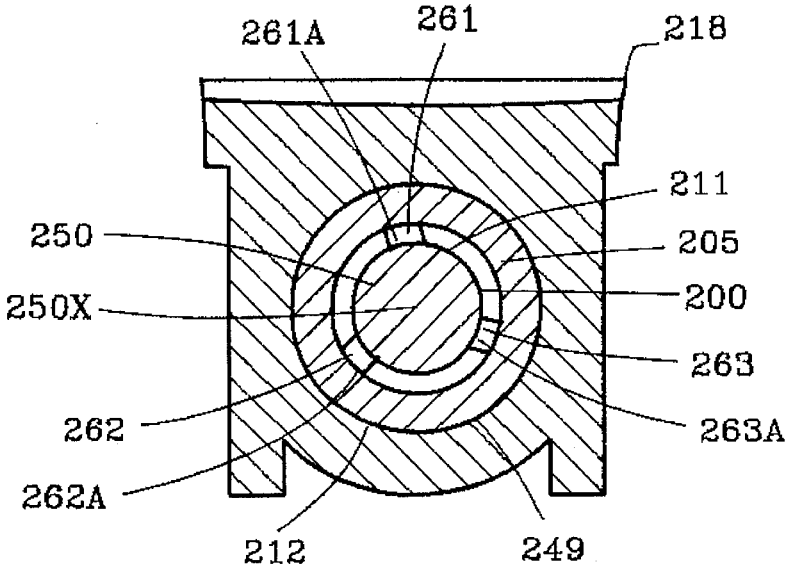
FIG. 10 is a sectional view along line 10—10 of FIG. 9.

FIG. 9 is an enlarged side section view of a portion of the actuator button 218 of FIGS. 6 and 8 with the terminal orifice insert 200 of FIGS. 5 and 7 inserted therein. FIG. 10 is a sectional view along line 10—10 of FIG. 9. The annular projection 256 of the actuator 218 is received within the annular recess 214 of the terminal orifice insert 200 for securing the terminal orifice insert 200 to the actuator button 218. The outer surface 212 of the annular wall 205 forms a seal with the cylindrical actuator wall 249.

A plurality of feed channels 261–263 are defined between the terminal orifice insert 200 and the cylindrical post 250. The feed channels are defined by indents defined between the terminal orifice insert 200 and the cylindrical post 250. The feed channels 261–263 include axial portions 261A–263A defined between the inner surface 211 of the annular wall 205 and the cylindrical outer post surface 251 of the cylindrical post 250. The feed channels 261–263 include radial portions 261B–263B defined between the inner face 204 of the front wall 202 and the planar cylindrical end 252 of the cylindrical post 250.

Figure 29:
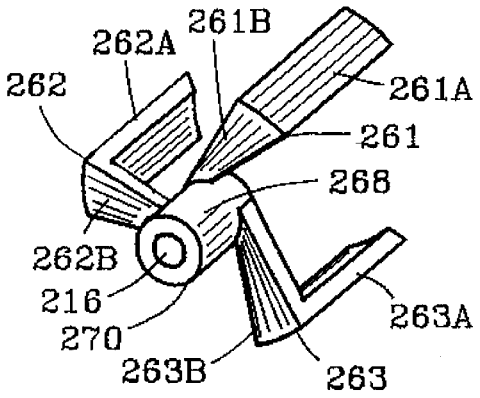
FIG. 29 Prior Art
FIG. 29 is a front isometric view of the plural feed channels of the prior art actuator button and terminal orifice insert of FIGS. 9 and 10.
Figure 30:
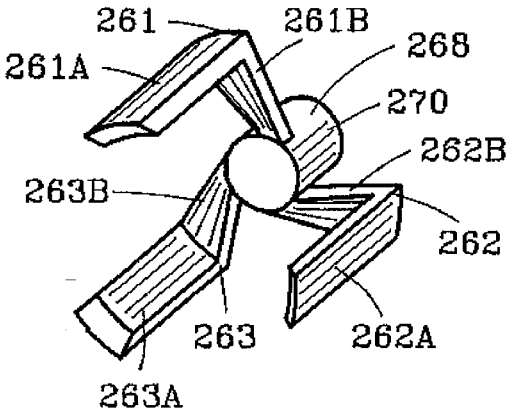
FIG. 30 is a rear isometric view of the plural feed channels of the prior art actuator button and terminal orifice insert of FIG. 29.

FIG. 29 is a front isometric view of the plural feed channels 261–263 of the prior art actuator button 218 and the terminal orifice insert of FIGS. 9 and 10 whereas FIG. 30 is a rear isometric view thereof. The radial portions 261B–263B are radially tapered relative to the axis 250X from a larger radial dimension at each of the intersections of the axial portions 261A—261A and the radial portions 261B—261B to a smaller radial dimension at each of the intersections of the radial portions 261B—261B with an outer wall 268 of a spin chamber 270. The radial portions 261B–263B have constant axial dimension between each of the intersections of the axial portions 261A—261A and the radial portions 261B—261B and each of the intersections of the radial portions 261B—261B with the outer wall 268 of the spin chamber 270, respectively. The spin chamber 270 is substantially cylindrical about the axis 250X and communicates with the terminal orifice 216.

The operation of the prior art actuator button 218 and the terminal orifice insert 200 should be well know to those skilled in the art. The product 12 under pressure enters the actuator button 218 through the bore 246 from the stem such as the stems 38 and 138 and is directed by the port 247 to the annular passage 248. The product 12 enters the axial portions 261A–263A of the plurality of feed channels 261–263 and makes a ninety degree (90°) turn to enter into the radial portions 261B–263B of the plurality of feed channels 261–263. The product 12 enters the spin chamber 270 from the radial portions 261B–263B of the plurality of feed channels 261–263 for centripetal acceleration within the spin chamber 270. The radial dimension of each of the radial portions 261B–263B at the intersection with the outer wall 268 of the spin chamber 270 is limited to approximately twenty-five percent (25%) of the diameter of the spin chamber 270 to insure that the product 12 is deflected off the outer wall 268 of the spin chamber 270 for funneling the product 12 into the terminal orifice 216.

One problem with the prior art the actuator button 218 and the terminal orifice insert 200 shown in FIGS. 5–10 is the reduction of the cross-sectional area of the radial portions 261B–263B of the plurality of feed channels 261–263 at the intersection with the outer wall 268 of the spin chamber 270 relative to the cross-sectional area of the radial portions 261B–263B of the plurality of feed channels 261–263 at the intersection with the axial portions 261A–263A of the plurality of feed channels 261–263. This reduction of the cross-sectional area causes an increase in the back pressure to the pressure propelling the product 12. The increase of the back pressure results in an increase in the pressure required to pass product 12 into the spin chamber 270. The back pressure also causes a drop in the pressure as the product 12 exits the plurality of feed channels 261–263 to enter into the spin chamber 270.

A further problem with the prior art actuator button 218 and the terminal orifice insert 200 shown in FIGS. 5–10 is the seal created between the terminal orifice insert 200 and the planar cylindrical end 252 of the cylindrical post 250 to form the plurality of feed channels 261–263 and the spin chamber 270. During the insertion of the terminal orifice insert 200 within the annular passage 248 on a rotary assembly machine, it is common to have the terminal orifice insert 200 oriented at a slight angle relative to the axis 250X when inserted into the annular passage 248. The slight angle of the terminal orifice insert 200 relative to the annular passage 248 is required due to the rotation of the rotary assembly machine. The presence of the slight angle of the terminal orifice insert 200 relative to the annular passage 248 necessitates the use of additional force to insure that the seal is created between the terminal orifice insert 200 and the planar cylindrical end 252 of the cylindrical post 250 to form the plurality of feed channels 261–263 and the spin chamber 270.

In many cases, the additional force pushes one side of the terminal orifice insert 200 further into the annular passage 248 than the other side of the terminal orifice insert 200 thus causing a misalignment of the terminal orifice insert 200 relative to the cylindrical post 250. The misalignments of the terminal orifice insert 200 relative to the cylindrical post 250 causes a cold flow of the plastic material forming the cylindrical post 250 to obstruct one or more of the axial portions 261A–263A of the feed channels 261–263. The obstructed one of the axial portions 261A–263A of the feed channels 261–263 has a reduced cross-sectional area that reduces the rate of flow of the obstructed feed channel 261–263 relative to the other feed channels 261–263.

Figure 11:
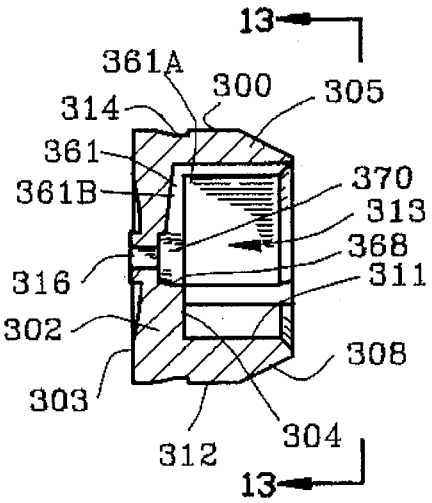
FIG. 11 is a twice enlarged side section view of a first embodiment of a terminal orifice insert for a dispenser incorporating the present invention.
Figure 13:
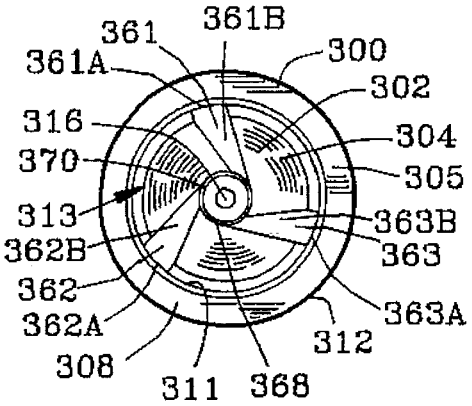
FIG. 13 is a view along line 13—13 of FIG. 11.

FIG. 11 is a twice enlarged side section view of a first embodiment of the terminal orifice insert 300 with FIG. 13 being a view along line 13—13 of FIG. 11. The terminal orifice insert 300 comprises a front wall 302 having an outer face 303 and an inner face 304. The terminal orifice insert 300 further comprises an annular wall 305 with a taper end 308 for facilitating the insert of the terminal orifice insert 300. The annular wall 305 includes an inner surface 311 and an outer surface 312 with the outer surface 312 defining a generally cylindrical void 313 communicating with a terminal orifice 316. The annular wall 305 includes an annular recess 314 for securing the terminal orifice insert 300.

Figure 12:
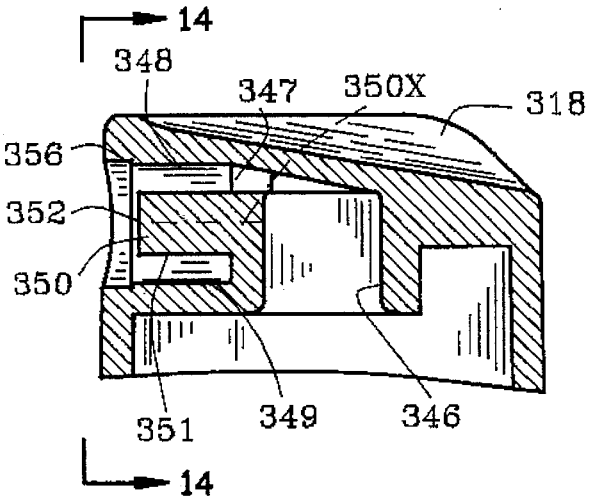
FIG. 12 is an enlarged side section view of a portion of an actuator for the dispenser incorporating the present invention.
Figure 14:
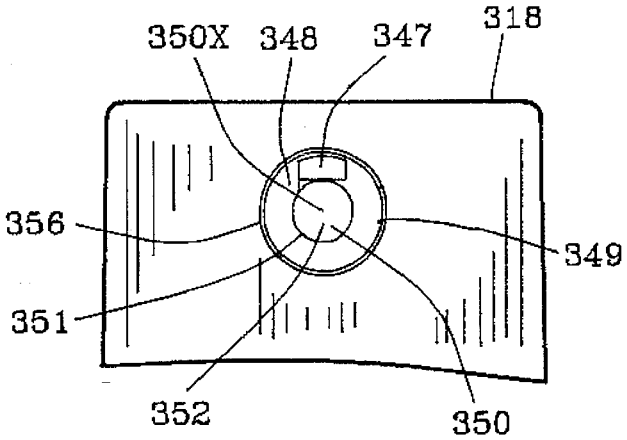
FIG. 14 is a view along line 14—14 of FIG. 12.

FIG. 12 is an enlarged side section view of a portion of an actuator button 318 that is identical to the prior art actuator button 218 shown in FIGS. 6 and 8. FIG. 14 is a view along line 14—14 of FIG. 12. The actuator button 318 includes a bore 346 for frictionally receiving a stem such as the stems 38 and 138. A port 347 interconnects the bore 346 with an annular passage 348 defined by a cylindrical actuator wall 349 and a cylindrical post 350. The cylindrical post 350 defines a substantially cylindrical outer post surface 351 about an axis 350X and terminates in a planar cylindrical end 352. An annular projection 356 is defined in an cylindrical actuator wall 349 for cooperating with the annular recess 314 for securing the terminal orifice insert 300 to the actuator button 318.

Figure 15:
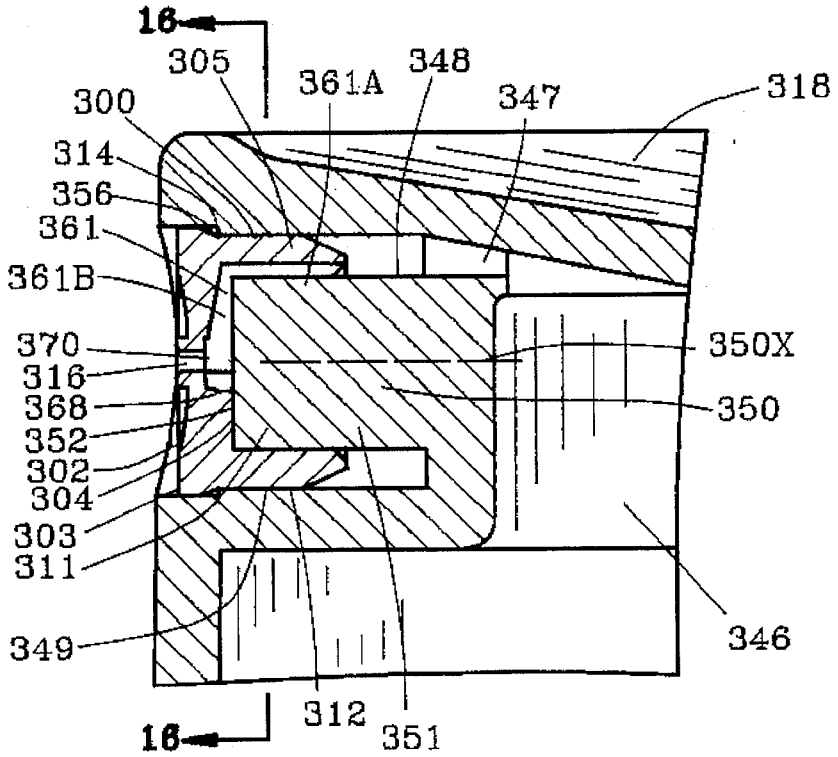
FIG. 15 is an enlarged side section view of a portion of the actuator of FIGS. 12 and 14 with the terminal orifice insert of FIGS. 11 and 13 inserted therein.
Figure 16:
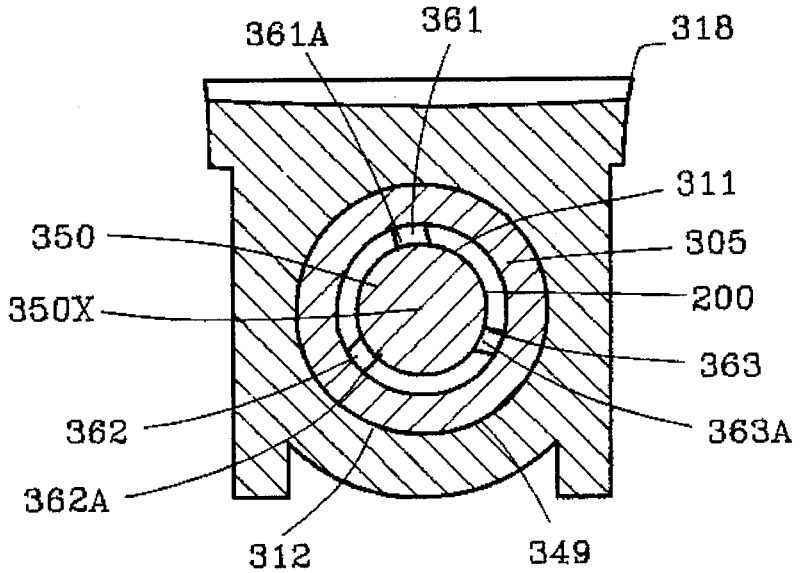
FIG. 16 is a sectional view along line 16—16 of FIG. 15.

FIG. 15 is an enlarged side section view of a portion of the actuator button 318 of FIGS. 12 and 14 with the terminal orifice insert 300 of FIGS. 11 and 13 inserted therein. FIG. 16 is a sectional view along line 16—16 of FIG. 15. The annular projection 356 of the actuator 318 is received within the annular recess 314 of the terminal orifice insert 300 for securing the terminal orifice insert 300 to the actuator button 318. The outer surface 312 of the annular wall 305 forms a seal with the cylindrical actuator wall 349.

A plurality of feed channels 361–363 are defined between the terminal orifice insert 300 and the cylindrical post 350. The feed channels are defined by indents defined in the terminal orifice insert 300 or the cylindrical post 350. The feed channels 361–363 include axial portions 361A–363A defined between the inner surface 311 of the annular wall 305 and the cylindrical outer post surface 351 of the cylindrical post 350. The feed channels 361–363 include radial portions 361B–363B defined between the inner face 304 of the front wall 302 and the planar cylindrical end 352 of the cylindrical post 350.

Figure 31:
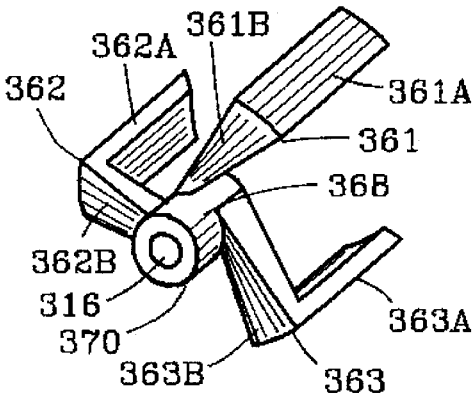
FIG. 31 is a front isometric view of the plural feed channels of the first embodiment of the actuator button and terminal orifice insert of FIGS. 15 and 16.
Figure 32:
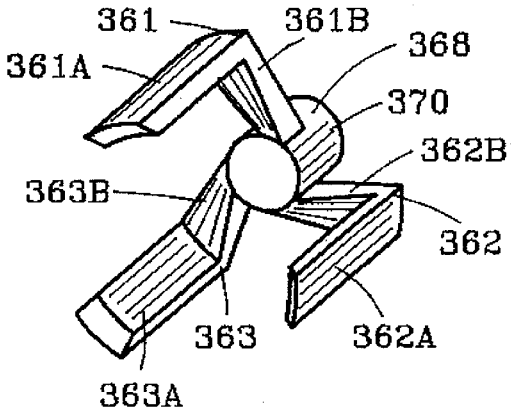
FIG. 32 is a rear isometric view of the plural feed channels of the first embodiment of the actuator button and terminal orifice insert of FIG. 31.

FIG. 31 is a front isometric view of the plural feed channels 361–363 of the first embodiment of the actuator button 318 and terminal orifice insert 300 of FIGS. 15 and 16 whereas FIG. 32 is a rear isometric view thereof. The radial portions 361B–363B are radially tapered relative to the axis 350X from a larger radial dimension at each of the intersections of the axial portions 361A–363A and the radial portions 361B–363B to a smaller radial dimension at each of the intersections of the radial portions 361B–363B with an outer wall 368 of a spin chamber 370. In contrast to the prior art feed channels 261–263 defined between the terminal orifice insert 200 and the cylindrical post 250, the radial portions 361B–363B of each of the plurality of feed channels 361–363 are axially tapered relative to the axis 350X from a smaller axial dimension at each of the intersections of the axial portions 361A–363A and the radial portions 361B–363B to a larger axial dimension at each of the intersections of the radial portions 361B–363B with an outer wall 368 of a spin chamber 370.

The radial portions 361B–363B are radially tapered from a larger radial dimension to a smaller radial dimension at spin chamber 370 and are axially tapered from a smaller axial dimension to a larger axial dimension at spin chamber 370. The radial taper and the axial taper of the radial portions 361B–363B provide a substantially constant cross-sectional area along each of the radial portions 361B–363B. Preferably, the substantially constant cross-sectional area along each of the radial portions 361B–363B is equal to the constant cross-sectional area along each of the axial portions 361B–363B of the feed channels 361–363.

The operation of the actuator button 318 and the terminal orifice insert 300 is similar to the operation of the prior art actuator button 218 and terminal orifice insert 200 set forth in FIGS. 5–10. The product 12 under pressure enters the actuator button 318 and is directed by the port 347 through the annular passage 348 to the plurality of feed channels 361–363. The product 12 enters the axial portions 361A–363A of the plurality of feed channels 361–363 and takes a ninety degree (90°) turn to enter and pass through the radial portions 361B–363B of the plurality of feed channels 361–363 into the spin chamber 370.

The actuator button 318 and the terminal orifice insert 300 overcome the problem produced by the reduction of the cross-sectional area of the radial portions 361B–363B of the plurality of feed channels 361–363. The substantially constant cross-sectional area along each of the radial portions 361B–363B eliminates any back pressure to the pressure propelling the product 12 caused by the radial portions 361B–363B of the feed channels 361–363. The actuator button 318 and the terminal orifice insert 300 provide a reduction back pressure into the spin chamber 37 relative to the prior art.

Figure 33:
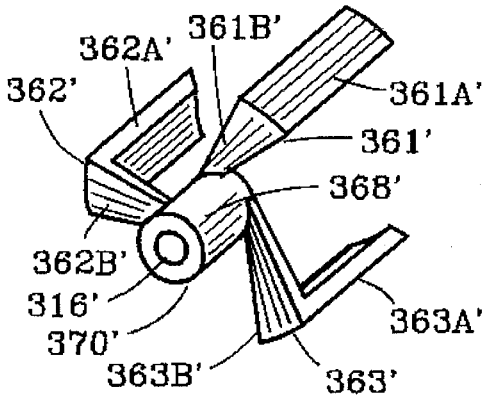
FIG. 33 is a front isometric view of a plural feed channels of a variation of the first embodiment of the actuator button and terminal orifice insert of FIGS. 15 and 16.
Figure 34:
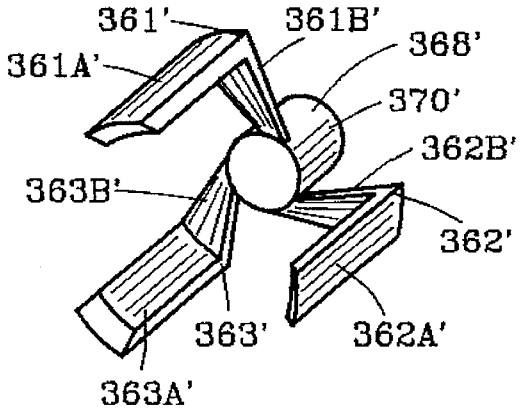
FIG. 34 is a rear isometric view of the plural feed channels of the variation of the first embodiment of the actuator button and terminal orifice insert of FIG. 33.

FIG. 33 is a front isometric view of a plural feed channels 361'–363' of a variation of the first embodiment of the actuator button 318' and the terminal orifice insert 300' of FIGS. 15 and 16. FIG. 34 is a rear isometric view of the plural feed channels 361'–363' of the variation of the first embodiment of the actuator button 318' and terminal orifice insert 300' of FIG. 33. The radial portions 361B'–363B' are radially tapered from a larger radial dimension to a smaller radial dimension at spin chamber 370' and are axially tapered from a larger axial dimension to a smaller axial dimension to the spin chamber 370. The decreasing cross-sectional area along each of the radial portions 361B'–363B' increases the back pressure to the pressure propelling the product 12 through the radial portions 361B'–363B' of the feed channels 361'–363'. For some applications, an increase in the back pressure within the radial portions 361B'–363B' of the feed channels 361'–363' to the spin chamber 370 may be desirable for spinning the product 12 prior to being discharged from the terminal orifice 316'.

Figure 17:
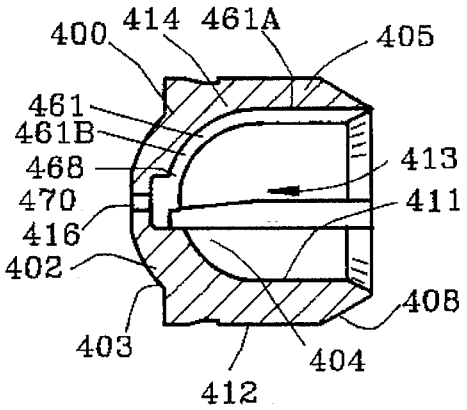
FIG. 17 is a twice enlarged side section view of a second embodiment of a terminal orifice insert for a dispenser incorporating the present invention.
Figure 19:
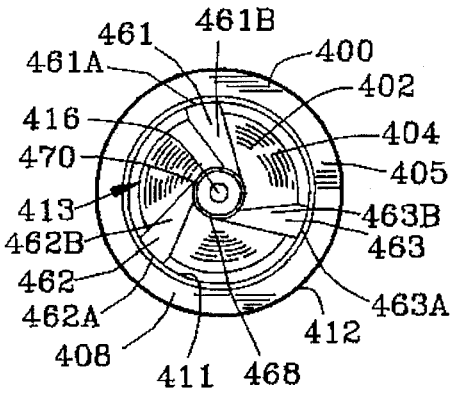
FIG. 19 is a right side view of FIG. 17.

FIG. 17 is a twice enlarged side section view of a second embodiment of the terminal orifice insert 400 with FIG. 19 being a right side view of FIG. 17. The terminal orifice insert 400 comprises an arcuate front wall 402 having an arcuate outer face 403 and a hemispherical inner face 404. The terminal orifice insert 400 further comprises an annular wall 405 with a taper end 408 for facilitating the insert of the terminal orifice insert 400. The annular wall 405 includes an inner surface 411 and an outer surface 412 with the outer surface 412 defining a generally cylindrical void 413 communicating with a terminal orifice 416. The annular wall 405 includes an annular recess 414 for securing the terminal orifice insert 400.

Figure 18:
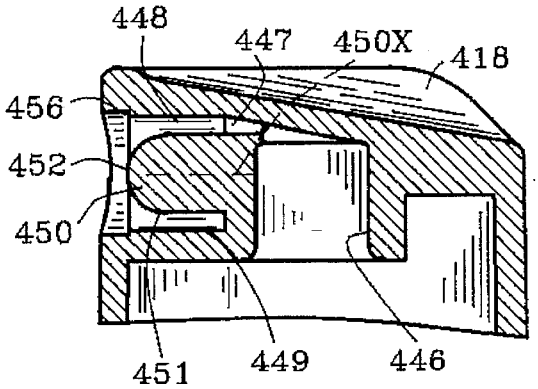
FIG. 18 is an enlarged side section view of a portion of an actuator for the dispenser incorporating the present invention.
Figure 20:
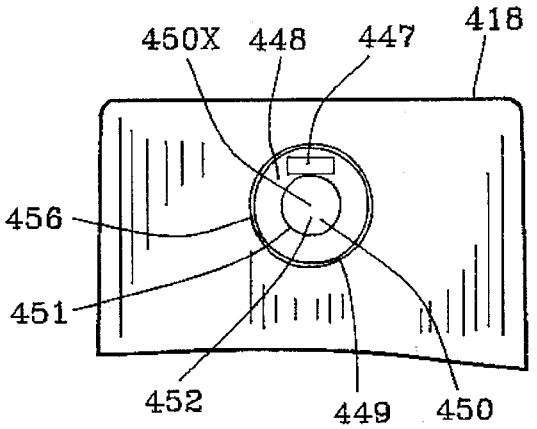
FIG. 20 is a left side view of FIG. 18.

FIG. 18 is an enlarged side section view of a portion of an actuator button 418 with FIG. 20 being a left side view of FIG. 18. The actuator button 418 includes a bore 446 for frictionally receiving a stem such as the stems 38 and 138. A port 447 interconnects the bore 446 with an annular passage 448 defined by a cylindrical actuator wall 449 and a cylindrical post 450. The cylindrical post 450 defines a substantially cylindrical outer post surface 451 about an axis 450X. In contrast to the prior art actuator button 218 shown in FIGS. 6 and 8, the cylindrical post 450 terminates in a hemispherical cylindrical end 452. An annular projection 456 is defined in a cylindrical actuator wall 449 for cooperating with the annular recess 414 for securing the terminal orifice insert 400 to the actuator button 418.

Figure 21:
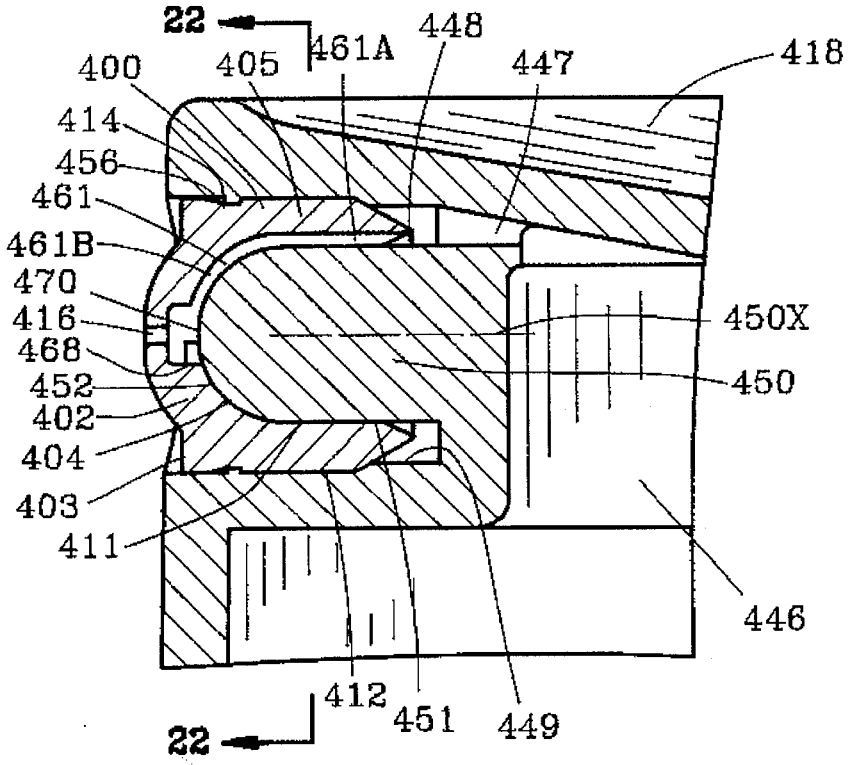
FIG. 21 is an enlarged side section view of a portion of the actuator of FIGS. 18 and 20 with the terminal orifice insert of FIGS. 17 and 19 inserted therein.
Figure 22:
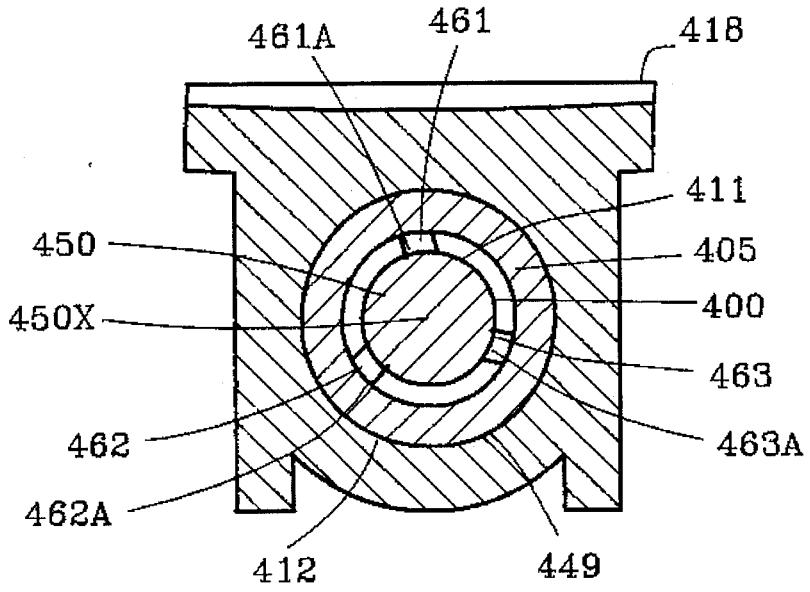
FIG. 22 is a sectional view along line 22—22 of FIG. 21.

FIG. 21 is an enlarged side section view of a portion of the actuator button 418 of FIGS. 18 and 20 with the terminal orifice insert 400 of FIGS. 17 and 19 inserted therein. FIG. 22 is a sectional view along line 22—22 of FIG. 21. The annular projection 456 of the actuator 418 is received within the annular recess 414 of the terminal orifice insert 400 for securing the terminal orifice insert 400 to the actuator button 418. The outer surface 412 of the annular wall 405 forms a seal with the cylindrical actuator wall 449.

A plurality of feed channels 461–463 are defined between the terminal orifice insert 400 and the cylindrical post 450. The feed channels are defined by indents defined in the terminal orifice insert 400 or the cylindrical post 450. The feed channels 461–463 include axial portions 461A–463A defined between the inner surface 411 of the annular wall 405 and the cylindrical outer post surface 451 of the cylindrical post 450. The feed channels 461–463 include generally radial portions 461B–463B defined between the hemispherical inner face 404 of the arcuate front wall 402 and the hemispherical cylindrical end 452 of the cylindrical post 450.

Figure 35:
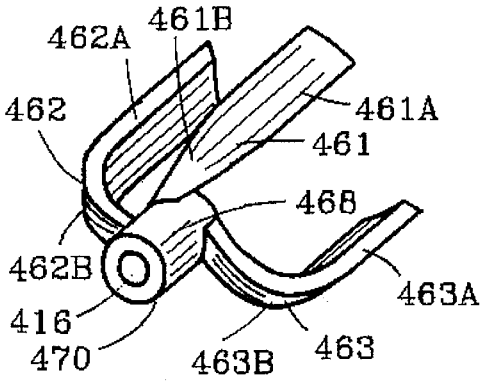
FIG. 35 is a front isometric view of the plural feed channels of the second embodiment of the actuator button and terminal orifice insert of FIGS. 21 and 22.
Figure 36:
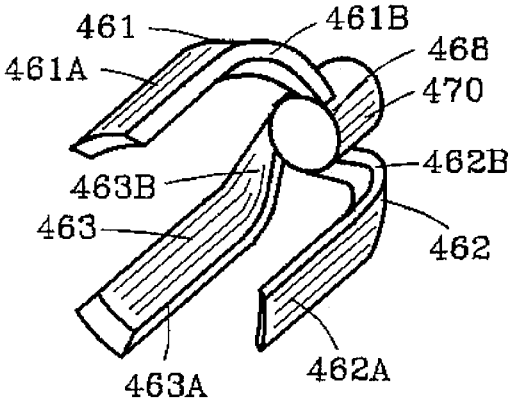
FIG. 36 is a rear isometric view of the plural feed channels of the second embodiment of the actuator button and terminal orifice insert of FIG. 35.

FIG. 35 is a front isometric view of the plural feed channels 461–463 of the second embodiment of the actuator button 418 and terminal orifice 400 insert of FIGS. 21 and 22 whereas FIG. 36 is a rear isometric view thereof. The generally radial portions 461B–463B are radially tapered relative to the axis 450X from a larger radial dimension at each of the intersections of the axial portions 461A–463A and the radial portions 461B–463B to a smaller radial dimension at each of the intersections of the radial portions 461B–463B with an outer wall 468 of a spin chamber 470. In a manner similar to the prior art actuator button 218 shown in FIGS. 6 and 8, the radial portions 461B–463B have a constant axial dimension between each of the intersections of the axial portions 461A–463A and the radial portions 461B–463B and each of the intersections of the radial portions 461B–463B with the outer wall 468 of the spin chamber 470, respectively.

The generally radial portions 461B–463B extend in an arcuate path between the intersections of the axial portions 461A–463A and the radial portions 461B–463B and the intersections of the radial portions 461B–463B with an outer wall 468 of a spin chamber 470. Although the arcuate path is shown as a partially circular path extending through an angle of substantially ninety degrees (90°), it should be appreciated that any other suitable curvature is contemplated and considered to be within the scope of the present invention.

The operation of the actuator button 418 and the terminal orifice insert 400 is similar to the operation of the prior art actuator button 218 and terminal orifice insert 400 set forth in FIGS. 5–10. The product 12 under pressure enters the actuator button 418 and is directed by the port 447 through the annular passage 448 to the plurality of feed channels 461–463. The product 12 enters the axial portions 461A–463A of the plurality of feed channels 461–463 and flows along the arcuate flow path from the axial portions 461A–463A and through the radial portions 461B–463B into the spin chamber 470.

The arcuate path of the generally radial portions 461B–463B provide a smooth arcuate flow path free from abrupt directional changes between the radial portions 461B–463B. Accordingly, the product 12 has a smooth flow path from the axial portions 461A–463A and through the radial portions 461B–463B into the spin chamber 470. The actuator button 418 and terminal orifice insert 400 provides an increased flow rate of the product 12 into the spin chamber 470 over the prior art.

The second embodiment of the invention overcomes the problem of possible misalignment of the terminal orifice insert 400 within the annular passage 448. The hemispherical cylindrical end 452 of the cylindrical post 450 operates as a centering device during insertion of the annular wall 405 of the terminal orifice insert 400 within the annular passage 448. Accordingly, in the event the terminal orifice insert 400 enters the annular passage 448 at an angle, the terminal orifice insert 400 can be inserted with proper alignment without the use of the additional force required by the prior art. In addition, the arcuate flow path of the radial portions 461B–463B reduces the total length of the feed channels 461–463.

Figure 23:
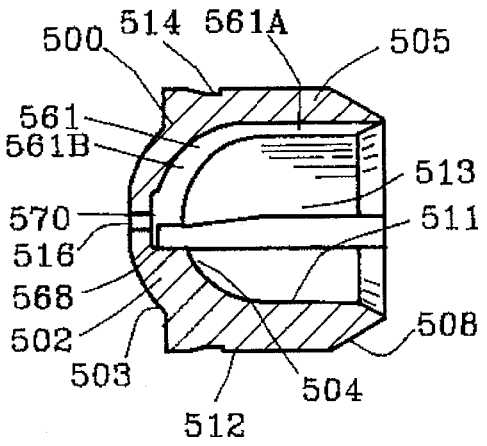
FIG. 23 is a twice enlarged side section view of a third embodiment of a terminal orifice insert for a dispenser incorporating the present invention.
Figure 25:
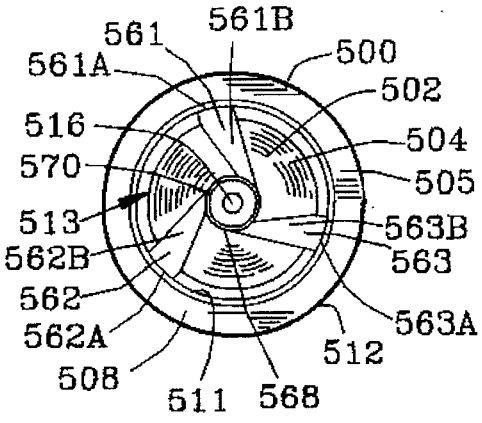
FIG. 25 is a right side view of FIG. 23.

FIG. 23 is a twice enlarged side section view of a third embodiment of the terminal orifice insert 500 with FIG. 25 being a right side view of FIG. 23. The terminal orifice insert 500 comprises an arcuate front wall 502 having an arcuate outer face 503 and a hemispherical inner face 504. The terminal orifice insert 500 further comprises an annular wall 505 with a taper end 508 for facilitating the insert of the terminal orifice insert 500. The annular wall 505 includes an inner surface 511 and an outer surface 512 with the outer surface 512 defining a generally cylindrical void 513 communicating with a terminal orifice 516. The annular wall 505 includes an annular recess 514 for securing the terminal orifice insert 500.

Figure 24:
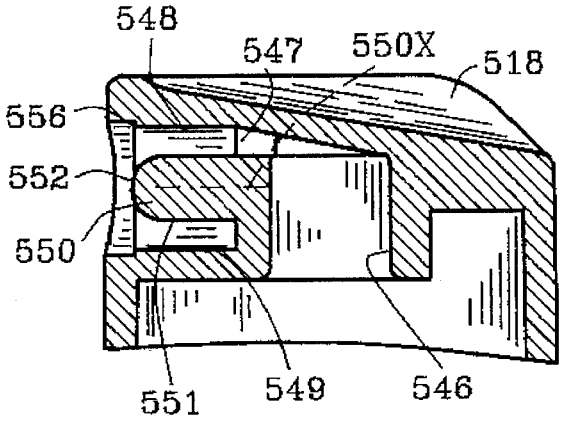
FIG. 24 is an enlarged side section view of a portion of an actuator for the dispenser incorporating the present invention.
Figure 26:
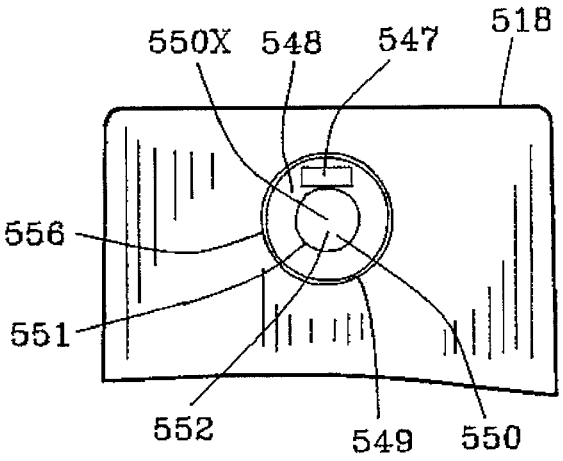
FIG. 26 is a left side view of FIG. 24.

FIG. 24 is an enlarged side section view of a portion of an actuator button 518 with FIG. 26 being a left side view of FIG. 24. The actuator button 518 includes a bore 546 for frictionally receiving a stem such as the stems 38 and 138. A port 547 interconnects the bore 546 with an annular passage 548 defined by a cylindrical actuator wall 549 and a cylindrical post 550. The cylindrical post 550 defines a substantially cylindrical outer post surface 551 about an axis 550X. In contrast to the prior art actuator button 518 shown in FIGS. 6 and 8, the cylindrical post 550 terminates in a hemispherical cylindrical end 552. An annular projection 556 is defined in an cylindrical actuator wall 549 for cooperating with the annular recess 514 for securing the terminal orifice insert 500 to the actuator button 518.

Figure 27:
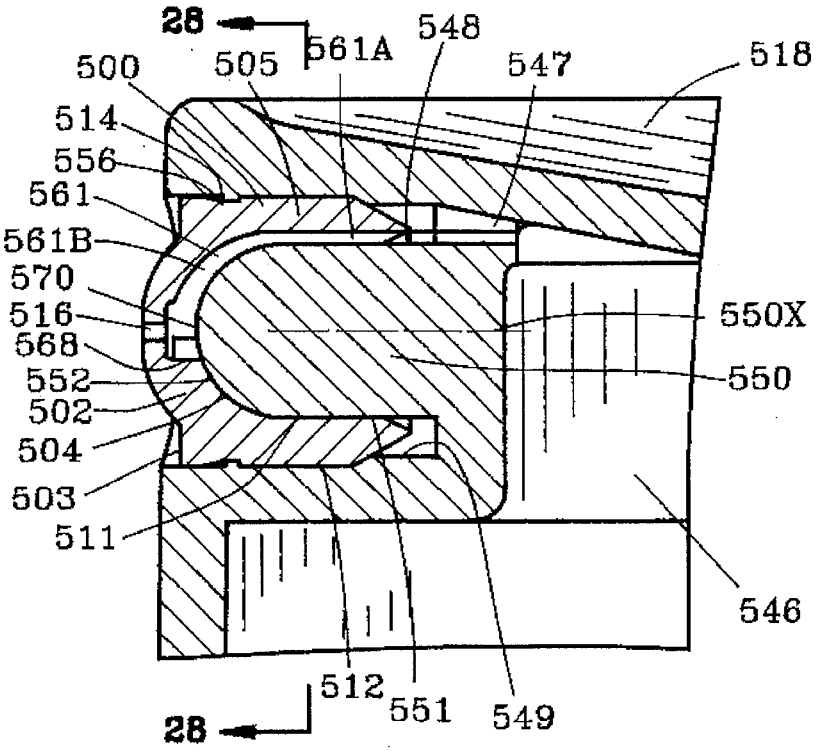
FIG. 27 is an enlarged side section view of a portion of the actuator of FIGS. 24 and 26 with the terminal orifice insert of FIGS. 23 and 25 inserted therein.

FIG. 27 is an enlarged side section view of a portion of the actuator button 518 of FIGS. 24 and 26 with the terminal orifice insert 500 of FIGS. 23 and 25 inserted therein. FIG, 28 is a sectional view along line 28—28 of FIG. 27. The annular projection 556 of the actuator 518 is received within the annular recess 514 of the terminal orifice insert 500 for securing the terminal orifice insert 500 to the actuator button 518. The outer surface 512 of the annular wall 505 forms a seal with the cylindrical actuator wall 549, A plurality of feed channels 561–563 are defined between the terminal orifice insert 500 and the cylindrical post 550. The feed channels are defined by indents defined in the terminal orifice insert 500 or the cylindrical post 550. The feed channels 561–563 include axial portions 561A–563A defined between the inner surface 511 of the annular wall 505 and the cylindrical outer post surface 551 of the cylindrical post 550, The feed channels 561–563 include generally radial portions 561B–563B defined between the hemispherical inner face 504 of the arcuate front wall 502 and the hemispherical cylindrical end 552 of the cylindrical post 550.

Figure 28:
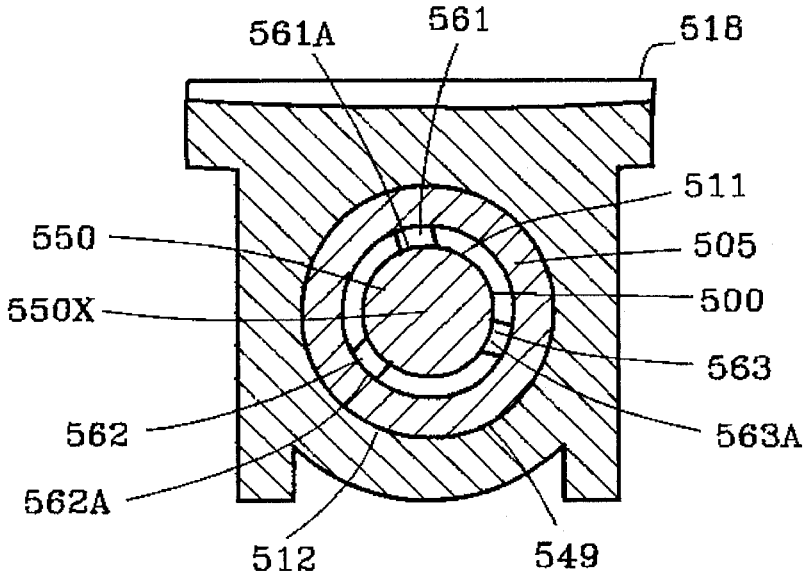
FIG. 28 is a sectional view along line 28—28 of FIG. 27.
Figure 37:
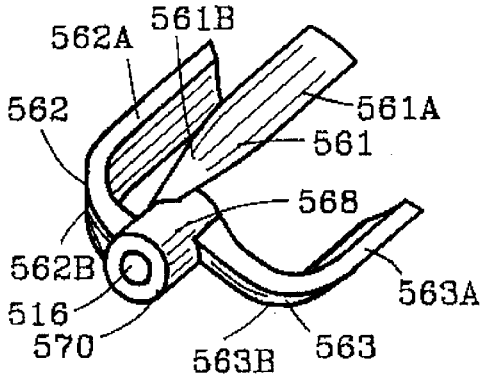
FIG. 37 is a front isometric view of the plural feed channels of the third embodiment of the actuator button and terminal orifice insert of FIGS. 27 and 28.
Figure 38:
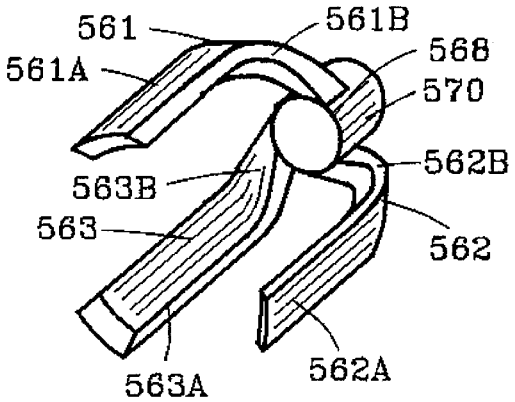
FIG. 38 is a rear isometric view of the plural feed channels of the third embodiment of the actuator button and terminal orifice insert of FIG. 37.

FIG. 37 is a front isometric view of the plural feed channels 561–563 of the third embodiment of the actuator button 518 and terminal orifice insert 500 of FIGS. 27 and 28 whereas FIG, 38 is a rear isometric view thereof, The generally radial portions 561B–563B are radially tapered relative to the axis 550X from a larger radial dimension at each of the intersections of the axial portions 561A–563A and the radial portions 561B–563B to a smaller radial dimension at each of the intersections of the radial portions 561B–563B with an outer wall 568 of a spin chamber 570.

In this third embodiment, the radial portions 561B–563B of each of the plurality of feed channels 561–563 are axially tapered relative to the axis 550X from a smaller axial dimension at each of the intersections of the axial portions 561A–563A and the radial portions 561B–563B to a larger axial dimension at each of the intersections of the radial portions 561B–563B with an outer wall 568 of a spin chamber 570, The radial portions 561B–563B are radially tapered from a larger radial dimension to a smaller radial dimension at spin chamber 570 and are axially tapered from a smaller axially dimension to a larger axial dimension at spin chamber 570. The radial taper and the axial taper of the radial portions 561B–563B provide a substantially constant cross-sectional area along each of the radial portions 561B–563B. Preferably, the substantially constant cross-sectional area along each of the radial portions 561B–563B is equal to the constant cross-sectional area along each of the axial portions 561B–563B of the feed channels 561–563.

The generally radial portions 561B–563B extend in an arcuate path between the intersections of the axial portions 561A–563A and the radial portions 561B–563B and the intersections of the radial portions 561B–563B with an outer wall 568 of a spin chamber 570. Although the arcuate path is shown as a partially circular path extending through an angle of substantially ninety degrees (90°), it should be appreciated that any other suitable curvature is contemplated amid considered to be within the scope of the present invention.

The operation of the actuator button 518 and the terminal orifice insert 500 is similar to the operation of the prior art actuator button 218 and terminal orifice insert 400 set forth in FIGS. 5–10. The product 12 under pressure enters the actuator button 518 and 540 and is directed by the port 547 through the annular passage 548 to the plurality of feed channels 561–563. The product 12 enters the axial portions 561A–563A of the plurality of feed channels 561–563 and flows along the arcuate flow path from the axial portions 561A–563A and through the radial portions 561B–563B into the spin chamber 570.

The substantially constant cross-sectional area along each of the radial portions 561B–563B eliminates any back pressure to the pressure propelling the product 12 caused by the radial portions 561B–563B of the feed channels 561–563. The actuator button 518 and the terminal orifice insert 500 provides a reduction back pressure into the spin chamber 570 relative to the prior art.

In addition, the arcuate path of the generally radial portions 561B–563B provide a smooth arcuate flow path free from abrupt directional changes between the radial portions 561B–563B. Accordingly, the product 12 has a smooth flow path from the axial portions 561A–563A and through the radial portions 561B–563B into the spin chamber 570. The actuator button 518 and terminal orifice insert 500 provides an increased flow rate of the product 12 into the spin chamber 570 over the prior art.

Figure 39:
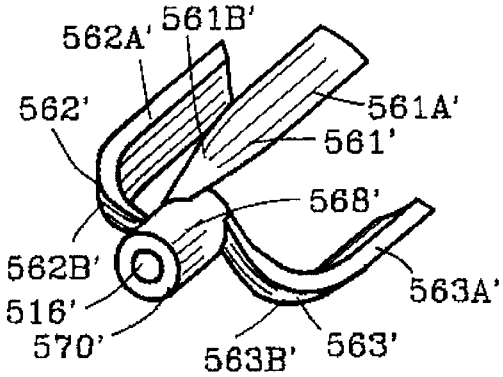
FIG. 39 is a front isometric view of a plural feed channels of a variation of the third embodiment of the actuator button and terminal orifice insert of FIGS. 27 and 28.
Figure 40:
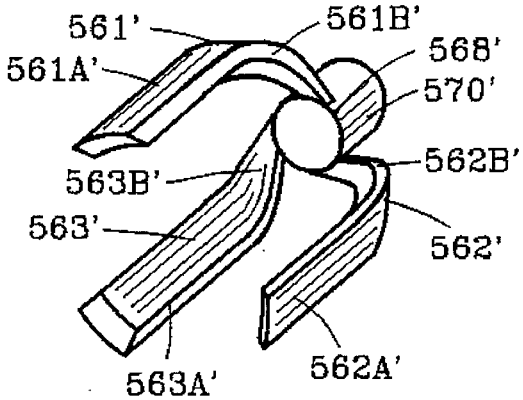
FIG. 40 is a rear isometric view of the plural feed channels of the variation of the third embodiment of the actuator button and terminal orifice insert of FIG. 39.

FIG. 39 is a front isometric view of a plural feed channels 561'–563' of a variation of the third embodiment of the actuator button 518' and terminal orifice insert 500' of FIGS. 27 and 28. FIG. 40 is a rear isometric view of the plural feed channels 561'–563' of the variation of the third embodiment of the actuator button 518 and terminal orifice insert 500' of FIG. 39. The radial portions 561B'–563B' are radially tapered from a larger radial dimension to a smaller radial dimension at spin chamber 570' and are axially tapered from a larger axial dimension to a smaller axial dimension the spin chamber 570'. The decreasing cross-sectional area along each of the radial portions 561B'–563B' increases the back pressure to the pressure propelling the product 12 through the radial portions 561B'–563B' of the feed channels 561'–563'. For some applications, an increase in the back pressure within the radial portions 561B'–563B' of the feed channels 561'–563' to the spin chamber 570 may be desirable for spinning the product 12 prior to being discharged from the terminal orifice 516'.

Furthermore, the third embodiment of the invention overcomes the problem of possible misalignment of the terminal orifice insert 500 within the annular passage 548 since the hemispherical cylindrical end 552 operates to center the terminal orifice insert 500 during insertion in the annular passage 548.

The third embodiment of the invention incorporates the benefits of both the first and second embodiments of the invention, the improved terminal orifice system of the present invention provides a high flow rate of the product that is suitable for use with existing aerosol dispensers and pumps.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved terminal orifice system for a hand operated dispensing device for dispensing a product from a terminal orifice, comprising:

a spin chamber communicating with the terminal orifice;

a plurality of feed channels providing communication between the hand operated dispensing device and said spin chamber for spinning the product about an axis within said spin chamber prior to discharge from the terminal orifice; and each of said plurality of feed channels being tapered to provide a smaller dimension at an intersection of each of said feed channels with said spin chamber while providing a substantially constant cross-sectional area along each of said feed channels.

2. An improved terminal orifice system for a hand operated dispensing device as set forth in claim 1, wherein said spin chamber is substantially cylindrical about said axis and with the terminal orifice being located along said axis.

3. An improved terminal orifice system for a hand operated dispensing device as set forth in claim 1, wherein said spin chamber is substantially cylindrical about said axis and with the terminal orifice being located along said axis; and each of said plurality of feed channels being disposed tangentially relative to said spin chamber at each of said intersections of said feed channels with said spin chamber.

4. An improved terminal orifice system for a hand operated dispensing device as set forth in claim 1, wherein each of said plurality of feed channels is radially tapered relative to said axis from a larger radial dimension to a smaller radial dimension at each of said intersections of said feed channels with said spin chamber: and each of said plurality of feed channels being axially tapered relative to said axis from a smaller axially dimension to a larger axial dimension at each of said intersections of said feed channels with said spin chamber to provide a substantially constant cross-sectional area in each of said feed channels.

5. An improved terminal orifice system for a hand operated dispensing device for dispensing a product from a terminal orifice, comprising:

a substantially cylindrical spin chamber defined about an axis with said spin chamber communicating with the terminal orifice along said axis;

a plurality of feed channels intersecting tangentially with said spin chamber for providing communication between the hand operated dispensing device and said spin chamber for spinning the product about an axis within said spin chamber prior to discharge from the terminal orifice: and each of said plurality of feed channels being radially tapered relative to said axis from a larger radial dimension to a smaller radial dimension at each of said intersections of said feed channels with said spin chamber and being axially tapered to provide a substantially constant cross-sectional area along each of said feed channels.

6. An improved terminal orifice system for a hand operated dispensing device as set forth in claim 5, wherein each of said plurality of feed channels is axially tapered relative to said axis from a smaller axially dimension to a larger axial dimension at each of said intersections of said feed channels with said spin chamber to provide a substantially constant cross-sectional area along each of said feed channels.

7. An improved terminal orifice system for a hand operated dispensing device as set forth in claim 5, wherein said substantially cylindrical spin chamber includes a support having an output channel in fluid communication with the hand operated dispensing device;

an annular recess formed in said support communicating with said output channel; and a terminal orifice insert being insertable within said annular recess of said support for defining said substantially cylindrical spin chamber.

8. An improved terminal orifice system for a hand operated dispensing device as set forth in claim 5, wherein said substantially cylindrical spin chamber includes a support having an output channel in fluid communication with the hand operated dispensing device;

an annular recess formed in said support communicating with said output channel and defining a post having a substantially cylindrical outer post surface and a substantially hemispherical post end;

a terminal orifice insert being insertable within said annular recess of said support for defining said substantially cylindrical spin chamber between said substantially hemispherical post end and said terminal orifice insert and for defining said plurality of feed channels between said post and said terminal orifice insert; and said substantially hemispherical post end providing each of said plurality of feed channels to be arcuate between said substantially cylindrical outer post surface and said substantially hemispherical post end.

9. An improved terminal orifice system for a hand operated dispensing device as set forth in claim 5, wherein said substantially cylindrical spin chamber includes a support having an output channel in fluid communication with the hand operated dispensing device;

an annular recess formed in said support communicating with said output channel and defining a post having a substantially cylindrical outer post surface and a substantially hemispherical post end:

a terminal orifice insert being insertable within said annular recess of said support for defining said substantially cylindrical spin chamber between said substantially hemispherical post end of said post and said terminal orifice insert with said axis being aligned with a post axis of said substantially cylindrical outer post surface;

said terminal orifice insert defining said plurality of feed channels between said post and said terminal orifice insert; and said substantially hemispherical post end providing each of said plurality of feed channels to be arcuate between said substantially cylindrical outer post surface and said substantially hemispherical post end.

10. An improved terminal orifice system for a hand operated dispensing device for dispensing a product from a terminal orifice, comprising:

a support having an output channel in fluid communication with the hand operated dispensing device;

an annular recess formed in said support communicating with said output channel and defining a post having an outer post surface and a substantially hemispherical post end;

a terminal orifice insert being insertable within said annular recess of said support for defining a spin chamber between said substantially hemispherical post end of said post and said terminal orifice insert;

said terminal orifice insert defining a plurality of feed channels between said post and said terminal orifice insert for providing communication between said output channel and said spin chamber for spinning the product within said spin chamber prior to discharge from the terminal orifice; and said substantially hemispherical post end providing each of said plurality of feed channels to be arcuate between said outer post surface and said substantially hemispherical post end.

11. An improved terminal orifice system for a hand operated dispensing device as set forth in claim 10, wherein said post has a substantially cylindrical outer post surface and a substantially hemispherical post end.

12. An improved terminal orifice system for a hand operated dispensing device as set forth in claim 10, wherein said recess is annular and said post has a substantially cylindrical outer post surface and a substantially hemispherical post end; and said spin chamber being substantially cylindrical about an axis with said axis of said spin chamber being aligned with a post axis of said substantially cylindrical outer post surface.

13. An improved terminal orifice system for a hand operated dispensing device as set forth in claim 10, wherein said substantially hemispherical post end provides each of said plurality of feed channels to be arcuate through an angle of substantially ninety degrees between said outer post surface and said substantially hemispherical post end.

14. An improved terminal orifice system for a hand operated dispensing device as set forth in claim 10, wherein each of said plurality of feed channels is radially tapered from a larger radial dimension to a smaller radial dimension at each intersection of said feed channels with said spin chamber; and each of said plurality of feed channels being axially tapered relative to said axis from a smaller axially dimension to a larger axial dimension at each of said intersections of said feed channels with said spin chamber to provide a substantially constant cross-sectional area in each of said feed channels.

15. An improved terminal orifice system for a hand operated dispensing device for dispensing a product from a terminal orifice, comprising:

a support having an output channel in fluid communication with the hand operated dispensing device;

an annular recess formed in said support communicating with said output channel and defining a post having a substantially cylindrical outer post surface and a substantially hemispherical post end;

a terminal orifice insert being insertable within said annular recess of said support for defining a substantially cylindrical spin chamber between said substantially hemispherical post end of said post and said terminal orifice insert with an axis of said spin chamber being aligned with a post axis of said substantially cylindrical outer post surface;

said spin chamber communicating with the terminal orifice:

said terminal orifice insert defining a plurality of feed channels between said post and said terminal orifice insert for providing communication between said output channel and said spin chamber for spinning the product about said axis within said spin chamber prior to discharge from the terminal orifice; and said substantially hemispherical post end providing each of said plurality of feed channels to be arcuate between said substantially cylindrical outer post surface and said substantially hemispherical post end.

16. An improved terminal orifice system for a hand operated dispensing device as set forth in claim 15, wherein said spin chamber is substantially cylindrical about said axis and with the terminal orifice being located along said axis; and each of said plurality of feed channels being disposed tangentially relative to said spin chamber at each of said intersections of said feed channels with said spin chamber.

17. An improved terminal orifice system for a hand operated dispensing device as set forth in claim 15, wherein each of said plurality of feed channels is radially tapered from a larger radial dimension to a smaller radial dimension at each intersection of said feed channels with said spin chamber: and each of said plurality of feed channels being axially tapered from a smaller axially dimension to a larger axial dimension at each of said intersections of said feed channels with said spin chamber to provide a substantially constant cross-sectional area in each of said feed channels.

18. An improved terminal orifice system for a hand operated dispensing device as set forth in claim 15, wherein said substantially hemispherical post end provides each of said plurality of feed channels to be arcuate through an angle of substantially ninety degrees between said outer post surface and said substantially hemispherical post end.

19. An improved terminal orifice system for a hand operated dispensing device for dispensing a product from a terminal orifice, comprising:

a support having an output channel in fluid communication with the hand operated dispensing device;

an annular recess formed in said support communicating with said output channel;

a terminal orifice insert being insertable within said annular recess of said support;

a substantially cylindrical spin chamber having an axis with said spin chamber communicating with the terminal orifice;

a plurality of feed channels providing communication between said output channel and said substantially cylindrical spin chamber for spinning the product within the spin chamber about said axis prior to discharge from the terminal orifice; and each of said plurality of feed channels being radially tapered relative to said axis from a larger radial dimension to a smaller radial dimension at an intersection of said feed channels with said spin chamber and being axially tapered relative to said axis to provide a substantially constant cross-sectional area along each of said feed channels.

20. An improved terminal orifice system for a hand operated dispensing device comprising a dispenser affixed to a container for dispensing a fluid within the container through a terminal orifice, the improvement comprising:

a support having an output channel in fluid communication with the hand operated dispensing device;

an annular recess formed in said support communicating with said output channel;

said annular recess defining a post having a substantially cylindrical outer post surface defined along a post axis:

said post having a substantially hemispherical post end:

a terminal orifice insert being insertable within said annular recess of said support for defining a substantially cylindrical spin chamber therebetween;

said spin chamber communicating with the terminal orifice;

a plurality of feed channels providing communication between said output channel and said substantially cylindrical spin chamber;

each of said plurality of feed channels having an axial portion thereof extending along said substantially cylindrical outer post surface and having a radial portion thereof extending along said substantially hemispherical post end;

each of said radial portions of said plurality of feed channels being radially tapered relative to said axis from a larger radial dimension to a smaller radial dimension at an intersection of said feed channels with said spin chamber; and each of said radial portions of said plurality of feed channels being axially tapered relative to said axis from a smaller axially dimension to a larger axial dimension at said intersection of said feed channels with said spin chamber to provide a substantially constant cross-sectional area along said feed channel to increase the flow rate of the product into said spin chamber.

21. An improved terminal orifice system for a hand operated dispensing device comprising a dispenser affixed to a container for dispensing a fluid within the container through a terminal orifice, the improvement comprising:

a support having an output channel in fluid communication with the hand operated dispensing device:

an annular recess formed in said support communicating with said output channel;

said annular recess defining a post having an outer post surface defined along a post axis and a post end:

a terminal orifice insert being insertable within said annular recess of said support for defining a substantially cylindrical spin chamber therebetween;

said spin chamber communicating with the terminal orifice;

a plurality of feed channels providing communication between said output channel and said substantially cylindrical spin chamber;

each of said plurality of feed channels having an axial portion thereof extending along said outer post surface and having a radial portion thereof extending along said post end:

each of said radial portions of said plurality of feed channels being radially tapered relative to said axis; and each of said radial portions of said plurality of feed channels being axially tapered relative to said axis to control flow rate of the product into said spin chamber.

* * * * *